US006380914B1

(12) United States Patent
Xie

(10) Patent No.: US 6,380,914 B1
(45) Date of Patent: Apr. 30, 2002

(54) METHOD FOR IMPROVING LIFE OF A FIELD EMISSION DISPLAY

(75) Inventor: Chenggang Xie, Phoenix, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/364,993

(22) Filed: Aug. 2, 1999

(51) Int. Cl.[7] ..... G09G 3/22
(52) U.S. Cl. ..... 345/75.2; 345/74.1
(58) Field of Search ..... 345/74.1, 75.1, 345/75.2

(56) References Cited

U.S. PATENT DOCUMENTS

| | | | | |
|---|---|---|---|---|
| 4,924,148 A | * | 5/1990 | Schwartz | 315/169.4 |
| 5,587,720 A | | 12/1996 | Fukuta et al. | 345/75 |
| 5,610,478 A | | 3/1997 | Kato et al. | 315/169.1 |
| 5,619,098 A | * | 4/1997 | Toki et al. | 313/496 |
| 5,754,216 A | * | 5/1998 | Higuchi et al. | 347/238 |
| 6,169,529 B1 | * | 1/2001 | Hansen et al. | 345/74 |
| 6,204,834 B1 | * | 3/2001 | Baker et al. | 345/74 |
| 6,259,437 B1 | * | 7/2001 | Onodaka et al. | 345/174 |

FOREIGN PATENT DOCUMENTS

| | | |
|---|---|---|
| JP | 9117272 | 5/1997 |
| JP | 9213268 | 2/1999 |

* cited by examiner

*Primary Examiner*—Bipin Shalwala
*Assistant Examiner*—Ricardo Osorio
(74) *Attorney, Agent, or Firm*—S. Kevin Pickens; Kevin D. Wills; William E. Koch

(57) ABSTRACT

A method for improving life of a field emission display (100), which has a plurality of electron emitters (118) and an anode (124), includes the steps of causing plurality of electron emitters (118) to emit electrons, applying a first anode voltage to anode (124), thereafter applying a second anode voltage to anode (124), and thereafter applying a third anode voltage to anode (124). The first anode voltage and the second anode voltage are selected to cause electrons emitted by plurality of electron emitters (118) to be attracted toward anode (124). The third anode voltage is selected to cause electrons emitted by plurality of electron emitters (118) to not be attracted toward anode (124). Furthermore, the second anode voltage is selected to be less than the first anode voltage.

24 Claims, 2 Drawing Sheets

METHOD FOR IMPROVING LIFE OF A FIELD EMISSION DISPLAY

FIELD OF THE INVENTION

The present invention relates, in general, to methods for improving the life of field emission displays, and, more particularly, to methods for in situ conditioning of electron emitters within field emission displays.

BACKGROUND OF THE INVENTION

Field emission displays are well known in the art. A field emission display includes an anode plate and a cathode plate that define a thin envelope. The cathode plate includes column electrodes and gate extraction electrodes, which are used to cause electron emission from electron emitter structures, such as Spindt tips.

During the operating life of a field emission display, the emissive surfaces of the electron emitter structures can be altered, such as by adsorption of contaminants that are evolved from surfaces within the display envelope. The contaminated emissive surfaces typically have electron emission properties that are inferior to those of the initial, uncontaminated emissive surfaces.

It is known in the art to decontaminate or condition the emissive surfaces by scrubbing them with an electron beam in situ. The electron beam may be provided by the electron emitter structures. An example of this scheme is described in U.S. Pat. No. 5,587,720, entitled "Field Emitter Array and Cleaning Method of the Same" by Fukuta et al. However, this type of scheme can result in inefficient cleaning due to the electronic bombardment of surfaces other than the electron emissive surfaces, which can result in undesirable desorption of contaminants.

Accordingly, there exists a need for a method for improving the life of a field emission display, which overcomes at least this shortcoming of the prior art.

BRIEF DESCRIPTION OF THE DRAWINGS

Referring to the drawings.

Figure 1:
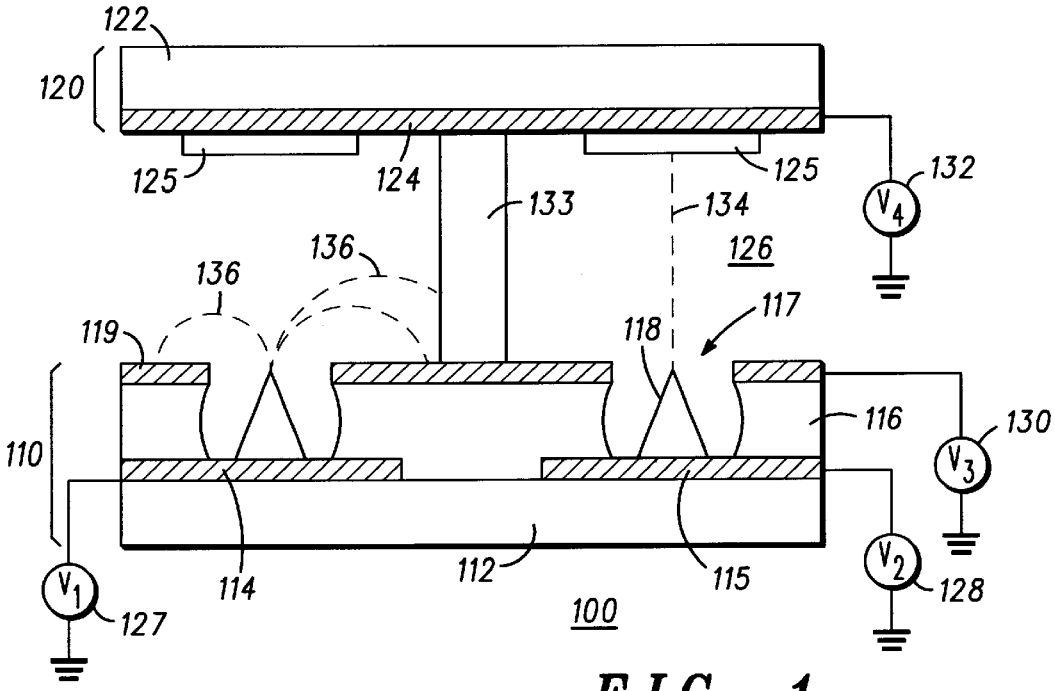
FIG. 1 is a cross-sectional view of a field emission display, in accordance with a preferred embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a method for improving life of a field emission display. The method of the invention includes the steps of causing a plurality of electron emitters to emit electrons and applying to an anode a first anode voltage, which is selected to attract to the anode electrons emitted by the electron emitters and to provide an emission current at the anode.

The method of the invention further includes the step of applying to the anode a second anode voltage, which is less than the first anode voltage and which is selected to attract to the anode electrons emitted by the electron emitters. During the step of applying the second anode voltage, the electron emitters are cleaned and conditioned, resulting in the benefit of partially recovering emission current lost during the step of applying the first anode voltage.

The method of the invention further includes the step of applying to the anode a third anode voltage, which is selected to not attract electrons to the anode. During the step of applying the third anode voltage, positively charged surfaces within the display are neutralized, resulting in further recovery of emission current.

FIG. 1 is a cross-sectional view of a field emission display (FED) 100, in accordance with a preferred embodiment of the invention. FED 100 includes a cathode plate 110 and an anode plate 120. Cathode plate 110 includes a substrate 112, which can be made from glass, silicon, and the like. A first cathode 114 and a second cathode 115 are disposed upon substrate 112. First cathode 114 is connected to a first voltage source 127, $V_1$, and second cathode 115 is connected to a second voltage source 128, $V_2$. A dielectric layer 116 is disposed upon cathodes 114 and 115, and further defines a plurality of emitter wells 117.

An electron emitter 118, such as a Spindt tip, is disposed in each of wells 117. Anode plate 120 is disposed to receive an emission current 134, which is defined by electrons emitted by electron emitters 118. A gate electrode 119 is formed on dielectric layer 116 and is spaced apart from and is proximate to electron emitters 118. Gate electrode 119 is connected to a third voltage source 130, $V_3$. Cathodes 114 and 115, gate electrode 119, and voltage sources 127, 128, and 130 are useful for selectively addressing electron emitters 118 and causing electrons to be emitted therefrom.

To facilitate understanding, FIG. 1 depicts only a couple of cathodes and one gate electrode. However, it is desired to be understood that any number of cathodes and gate electrodes can be employed. An exemplary number of gate electrodes for a FED is 240, and an exemplary number of cathodes is 960. Methods for fabricating cathode plates for matrix-addressable FED's are known to one of ordinary skill in the art.

Anode plate 120 includes a transparent substrate 122 made from, for example, glass. An anode 124 is disposed on transparent substrate 122. Anode 124 is preferably made from a transparent conductive material, such as indium tin oxide. In the preferred embodiment, anode 124 is a continuous layer that opposes the entire emissive area of cathode plate 110. That is, anode 124 preferably opposes the entirety of electron emitters 118. Anode 124 is connected to a fourth voltage source 132, $V_4$. Fourth voltage source 132 is useful for applying an anode voltage to anode 124.

A plurality of phosphors 125 are disposed upon anode 124. Phosphors 125 are cathodoluminescent. Thus, phosphors 125 emit light upon activation by emission current 134. Methods for fabricating anode plates for matrix-addressable FED's are also known to one of ordinary skill in the art.

In the preferred embodiment of FIG. 1, cathode plate 110 and anode plate 120 are spaced apart by a spacer 133, to define an interspace region 126. Spacer 133 can be made from a dielectric and can have one of a number of geometries, such as a post or rib. During the operation of FED 100, surfaces, such as the surfaces of spacer 133, may become electrostatically charged. These charged surfaces can attract some of the emitted electrons, resulting in a reduction of the magnitude of emission current 134. The method of the invention provides the benefit of at least a partial recovery of this lost current. The method of the invention employs a discharge mode of operation to realize this benefit.

The method of the invention further provides the benefit of recovering current lost due to contamination of electron emitters 118. Contamination of electron emitters 118 can occur during a display mode of operation and during the discharge mode of operation of FED 100. During the display mode of operation, electrons activate phosphors 125 to create a display image. The activation of phosphors 125 generates contaminants, which are introduced into interspace region 126.

During the discharge mode of operation, emitted electrons, which are represented by dashed curves 136 in FIG. 1, are used to neutralize electrostatically charged surfaces, such as the surfaces of gate electrode 119 and of spacer 133. This discharging step also produces contaminants. The contamination of electron emitters 118 further reduces emission current 134. The method of the invention provides the benefit of at least a partial recovery of the current lost due to contamination of electron emitters 118. The method of the invention employs a cleaning mode of operation to realize this benefit.

Figure 2A:
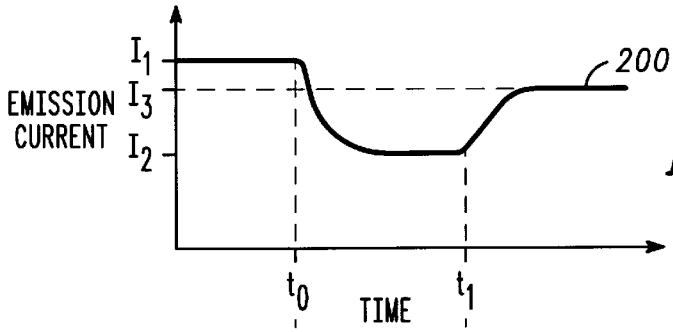
FIG. 2 is a timing diagram illustrating a method for improving life of a field emission display, in accordance with the invention.
Figure 2B:
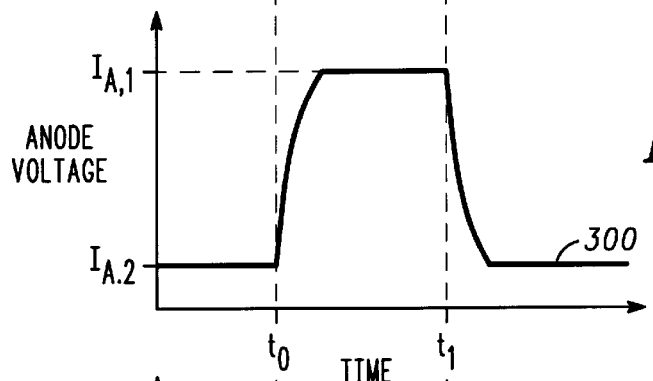
Figure 2C:
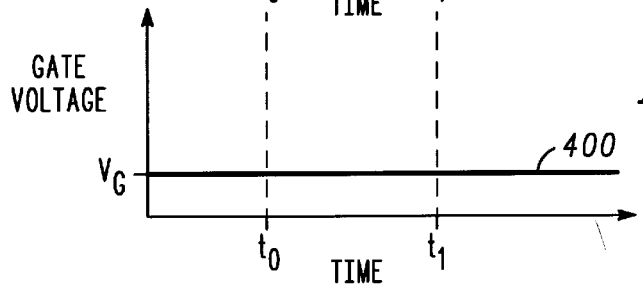
Figure 3A:
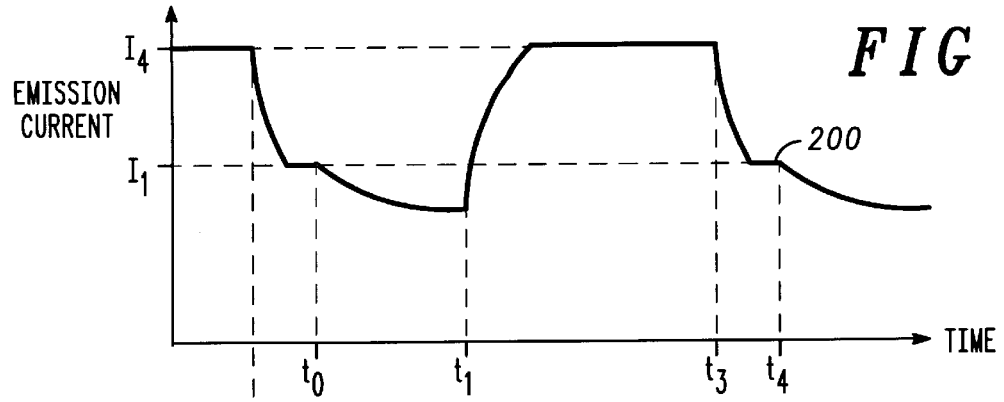
FIG. 3 is a timing diagram illustrating a preferred example for improving life of a field emission display, in accordance with the method of the invention.
Figure 3B:
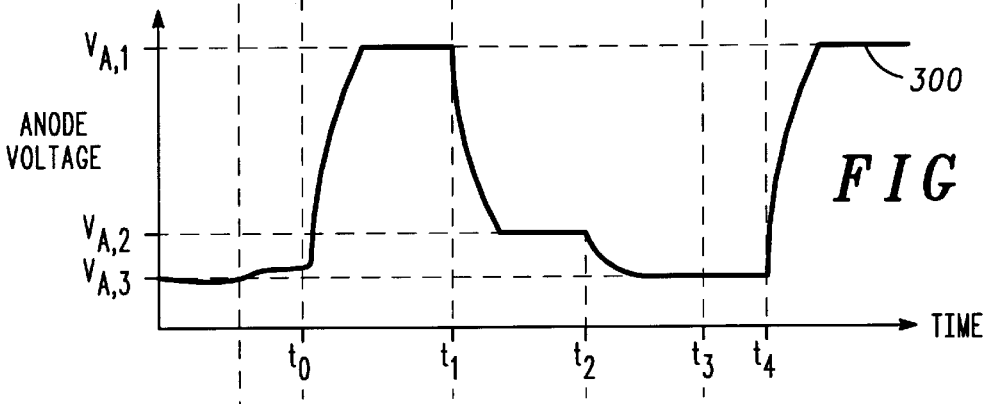
Figure 3C:
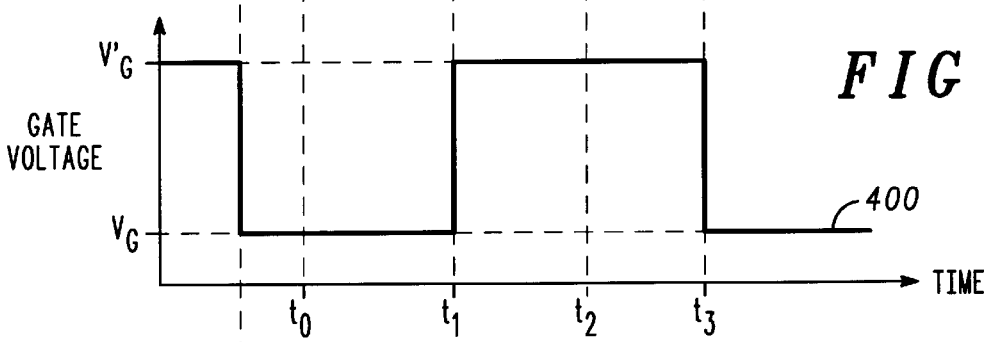
Figure 3D:
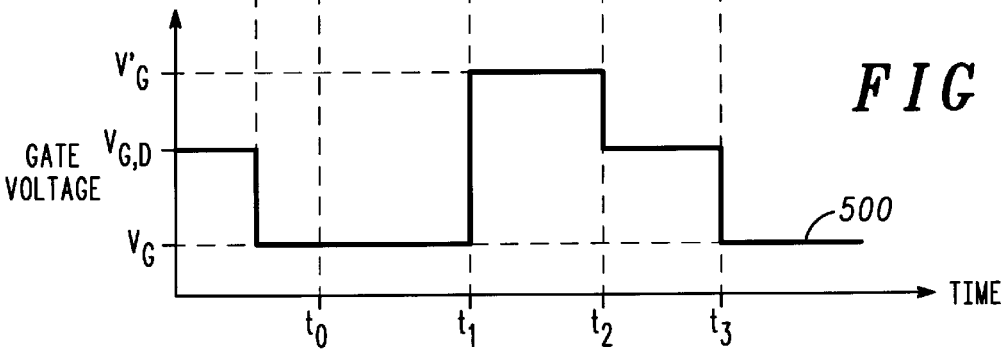

FIG. 2 is a timing diagram illustrating a method for improving life of a field emission display, in accordance with the invention. In the example of FIG. 2, a gate voltage, which is illustrated by a graph 400, is applied to gate electrode 119. The gate voltage is selected to cause electron emission from electron emitters 118 during both the display and cleaning modes of operation of FED 100. In the example of FIG. 2, the gate voltage is held constant at a value of $V_G$.

The display mode of operation commences at time to and ends at time $t_1$. The display mode of operation is characterized by the creation of a display image at anode plate 120. An anode voltage, which is illustrated by a graph 300 in FIG. 2, is applied to anode 124. During the display mode of operation, a first anode voltage, $V_{A,1}$, is applied to anode 124. The value of $V_{A,1}$ is selected to cause electrons emitted by electron emitters 118 to be attracted toward anode 124, and is further selected to provide a desired level of brightness for the display image.

In accordance with the method of the invention, at time $t_1$, a second anode voltage, $V_{A,2}$, is applied to anode 124. The magnitude of $V_{A,2}$ is less than that of $V_{A,1}$ and is selected to cause electrons emitted by electron emitters 118 to be attracted toward anode 124.

Preferably, $V_{A,1}$ is a voltage within the range of 1000–3000 volts, and $V_{A,2}$ is a voltage within the range of 200–500 volts. Most preferably, $V_{A,1}$ is equal to about 3000 volts, and $V_{A,2}$ is equal to about 300 volts.

Further illustrated in FIG. 2 is a graph 200 of emission current 134. Prior to time $t_0$, emission current 134 is equal to $I_1$. During the display mode of operation, emission current 134 drops to $I_2$ due, at least in part, to the contamination of electron emitters 118. The cleaning mode of operation occurs during times greater than $t_1$.

In general, the cleaning is achieved by causing the rate of desorption of contaminants from electron emitters 118 to be greater than the rate of adsorption of contaminants thereto. Successful cleaning can be detected by a rise in emission current 134 at constant gate voltage. In the example of FIG. 2, emission current 134 is partially recovered and increases to a value of $I_3$.

The extent of cleaning can be controlled by manipulating during the cleaning mode of operation variables, such as the magnitudes of $V_{A,2}$ and $V_G$. For example, an increase in the gate voltage increases the electric field applied to electron emitters 118, causing enhanced field desorption of contaminants therefrom. Increasing the gate voltage also results in enhanced field emission of electrons, which causes the temperature of electron emitters 118 to rise. The higher temperature further enhances desorption of contaminants.

FIG. 3 is a timing diagram illustrating a preferred example for improving life of a field emission display, in accordance with the method of the invention. The preferred example of FIG. 3 further includes the step of applying a third anode voltage, $V_{A,3}$, to anode 124. The third anode voltage is selected to cause electrons emitted by electron emitters 118 to not be attracted toward anode 124. In this manner, the electrons are made available to discharge charged surfaces within FED 100. Preferably, the third anode voltage is equal to ground potential.

In FIG. 3, the application of the third anode voltage follows the application of the second anode voltage. However, the method of the invention is not limited to the order of application of voltages $V_{A,1}$ $V_{A,2}$, and $V_{A,3}$, which is illustrated in FIG. 3. For example, the discharge mode of operation can occur after the display mode of operation and prior to the cleaning mode of operation.

The example of FIG. 3 further illustrates the manipulation of the gate voltage (graph 400) and emission current 134 (graph 200) to achieve the benefits of enhanced cleaning and discharging, in accordance with the method of the invention. In the example of FIG. 3, the rate of electron emission during the cleaning mode of operation, which is indicated by an emission current $I_4$ in FIG. 3, is greater than the rate of electron emission during the display mode of operation. This emission-enhancement step provides the benefit of increased temperature at electron emitters 118, which enhances desorption of contaminants therefrom.

In the preferred example of FIG. 3, the emission-enhancement step includes the step of increasing the gate voltage from a display mode value of $V_G$ to a cleaning mode value of $V_G'$. The value of $V_G$ is selected to provide the desired value of emission current 134 for the display mode of operation. The value of $V_G'$ is selected to provide a desired net rate of desorption from electron emitters 118. In the preferred example of FIG. 3, the value of $V_G$ is less than the value of $V_G'$. The extent of cleaning can be detected by the extent of recovery of emission current $I_1$, subsequent to the cleaning and discharge modes of operation, as indicated by graph 200 at times between $t_3$ and $t_4$.

In accordance with the method of the invention, the rate of electron emission can also be manipulated during the discharge mode of operation, which commences at time $t_2$. FIG. 3 depicts two examples of this step. In the first example, the rate of electron emission during the discharge mode of operation is equal to the rate of electron emission during the cleaning mode of operation. That is, the gate voltage during the discharge and cleaning modes of operation is constant.

In the second example, an emission-reduction step is employed, such that the rate of electron emission during the discharge mode of operation is less than the rate of electron emission during the cleaning mode of operation. This reduced rate of electron emission can be employed to mitigate the generation of contaminants during the discharge mode of operation. The rate of electron emission generated at $V_G'$ may be greater than that necessary to discharge charged surfaces. If this condition exists, the gate voltage can be reduced to a value, $V_{G,d}$, sufficient to achieve discharge, while eliminating unnecessary emission, which would otherwise generate contaminants. As illustrated by graph 200 in FIG. 3, the combined effects of the cleaning and discharge modes of operation produce the benefit of the recovery of emission current $I_1$ for use during the next display mode period, which commences at $t_4$.

The cleaning and discharge modes operation of the invention can be performed at the end of each display frame or at the end of a selected number of display frames. At that time, all of the electron emitters of the cathode plate are caused to emit simultaneously. Alternatively, portions of the emitter array can be cleaned and/or discharged at different times.

It is desired to be understood that the graphs of gate voltage and emission current in the drawings do not depict the "off" state of the selected row of electron emitters. During the "off" state, the electron emitters do not emit electrons, and the remaining rows of electron emitters are sequentially scanned. Thus, the scope of the invention is not limited to the particular waveforms shown in the drawings.

In summary, the invention is for a method useful for maintaining a constant emission current and thereby improving the life of a field emission display. In the preferred embodiment, the method of the invention includes three modes of operation: a display mode, during which the anode voltage is highest and electrons are attracted toward the anode; a discharge mode, during which the anode voltage is lowest and electrons are not attracted toward the anode; and a cleaning mode, during which the anode voltage has an intermediate value and electrons are attracted toward the anode. The discharge and cleaning modes of operation provide the benefit of at least partially recovering the emission current that is lost during the display mode of operation.

While I have shown and described specific embodiments of the present invention, further modifications and improvements will occur to those skilled in the art. For example, the step of applying a second anode voltage to the anode during the cleaning mode of operation can include the step of applying a graded voltage signal or several voltages, in step-function form. As a further example, the rate of electron emission during the cleaning and/or discharge modes of operation can be selected to be less than the rate of electron emission during the display mode of operation, to mitigate the desorption of contaminants from surfaces other than those of the electron emitters.

I desire it to be understood, therefore, that this invention is not limited to the particular forms shown, and I intend in the appended claims to cover all modifications that do not depart from the spirit and scope of this invention.

What is claimed is:

1. A method for improving life of a field emission display having a plurality of electron emitters and an anode, the method comprising the steps of:

causing the plurality of electron emitters to emit electrons;

applying a first anode voltage to the anode, wherein the first anode voltage is selected to cause electrons emitted by the plurality of electron emitters to be attracted toward the anode; and applying a second anode voltage to the anode, wherein the second anode voltage is less than the first anode voltage, and wherein the second anode voltage is selected to cause electrons emitted by the plurality of electron emitters to be attracted toward the anode.

2. The method for improving life of a field emission display as claimed in claim 1, wherein the step of applying a first anode voltage to the anode comprises the step of applying a voltage within the range of 1000–3000 volts to the anode, and wherein the step of applying a second anode voltage to the anode comprises the step of applying a voltage within the range of 200–500 volts to the anode.

3. The method for improving life of a field emission display as claimed in claim 2, wherein the step of applying a first anode voltage to the anode comprises the step of applying about 3000 volts to the anode, and wherein the step of applying a second anode voltage to the anode comprises the step of applying about 300 volts to the anode.

4. The method for improving life of a field emission display as claimed in claim 1, wherein the step of causing the plurality of electron emitters to emit electrons defines a rate of electron emission, and further comprising the emission-enhancement step of causing the rate of electron emission during the step of applying a second anode voltage to be greater than the rate of electron emission during the step of applying a first anode voltage.

5. The method for improving life of a field emission display as claimed in claim 4, wherein the field emission display further has a gate electrode, and wherein the emission-enhancement step comprises the step of applying to the gate electrode a first gate voltage concurrent with the step of applying a first anode voltage and further comprises the step of applying to the gate electrode a second gate voltage concurrent with the step of applying a second anode voltage, wherein the first gate voltage is less than the second gate voltage.

6. The method for improving life of a field emission display as claimed in claim 1, further comprising the step of applying a third anode voltage to the anode, wherein the third anode voltage is selected to cause electrons emitted by the plurality of electron emitters to not be attracted toward the anode.

7. The method for improving life of a field emission display as claimed in claim 6, wherein the step of applying a third anode voltage comprises the step of applying ground potential to the anode.

8. The method for improving life of a field emission display as claimed in claim 6, wherein the step of causing the plurality of electron emitters to emit electrons defines a rate of electron emission, and further comprising the emission-enhancement step of causing the rate of electron emission during the step of applying a second anode voltage to be greater than the rate of electron emission during the step of applying a first anode voltage.

9. The method for improving life of a field emission display as claimed in claim 8, wherein the field emission display further has a gate electrode, and wherein the emission-enhancement step comprises the step of applying to the gate electrode a first gate voltage concurrent with the step of applying a first anode voltage and further comprises the step of applying to the gate electrode a second gate voltage concurrent with the step of applying a second anode voltage, wherein the first gate voltage is less than the second gate voltage.

10. The method for improving life of a field emission display as claimed in claim 6, wherein the step of causing the plurality of electron emitters to emit electrons defines a rate of electron emission, and further comprising the emission-reduction step of causing the rate of electron emission during the step of applying a third anode voltage to be less than the rate of electron emission during the step of applying a second anode voltage.

11. The method for improving life of a field emission display as claimed in claim 10, wherein the field emission display further has a gate electrode, and wherein the emission-reduction step comprises the step of applying to the gate electrode a first gate voltage concurrent with the step of applying a second anode voltage and further comprises the step of applying to the gate electrode a second gate voltage concurrent with the step of applying a third anode voltage, wherein the first gate voltage is greater than the second gate voltage.

12. The method for improving life of a field emission display as claimed in claim 6, wherein the step of applying a first anode voltage to the anode comprises the step of applying a voltage within the range of 1000–3000 volts to the anode, and wherein the step of applying a second anode voltage to the anode comprises the step of applying a voltage within the range of 200–500 volts to the anode.

13. The method for improving life of a field emission display as claimed in claim 12, wherein the step of applying a first anode voltage to the anode comprises the step of applying about 3000 volts to the anode, and wherein the step of applying a second anode voltage to the anode comprises the step of applying about 300 volts to the anode.

14. A method for improving life of a field emission display having a plurality of electron emitters and an anode, the method comprising the steps of:

causing the plurality of electron emitters to emit electrons;

applying a first anode voltage to the anode having a first rate of electron emission, wherein the first anode voltage is selected to cause electrons emitted by the plurality of electron emitters to be attracted toward the anode; and applying a second anode voltage to the anode having a second rate of electron emission greater than the first rate of electron emission, wherein the second anode voltage is less than the first anode voltage, and wherein the second anode voltage is selected to cause electrodes emitted by the plurality of electron emitters to be attracted toward the anode.

15. The method for improving life of a field emission display as claimed in claim 14, wherein the step of applying a first anode voltage to the anode comprises the step of applying a voltage within the range of 1000–3000 volts to the anode, and wherein the step of applying a second anode voltage to the anode comprises the step of applying a voltage within the range of 200–500 volts to the anode.

16. The method for improving life of a field emission display as claimed in claim 15, wherein the step of applying a first anode voltage to the anode comprises the step of applying about 3000 volts to the anode, and wherein the step of applying a second anode voltage to the anode comprises the step of applying about 300 volts to the anode.

17. The method for improving life of a field emission display as claimed in claim 14, wherein the field emission display further has a gate electrode, and wherein the emission-enhancement step comprises the step of applying to the gate electrode a first gate voltage concurrent with the step of applying a first anode voltage and further comprises the step of applying to the gate electrode a second gate voltage concurrent with the step of applying a second anode voltage, wherein the first gate voltage is less than the second gate voltage.

18. The method for improving life of a field emission display as claimed in claim 14 further comprising the step of applying a third anode voltage to the anode, wherein the third anode voltage is selected to cause electrons emitted by the plurality of electron emitters to not be attracted toward the anode.

19. The method for improving life of a field emission display as claimed in claim 18 wherein the step of applying a third anode voltage comprises the step of applying ground potential to the anode.

20. The method for improving life of a field emission display as claimed in claim 18, wherein the field emission display further has a gate electrode, and wherein the emission-enhancement step comprises the step of applying to the gate electrode a first gate voltage concurrent with the step of applying a first anode voltage and further comprises the step of applying to the gate electrode a second gate voltage concurrent with the step of applying a second anode voltage, wherein the first gate voltage is less than the second gate voltage.

21. The method for improving life of a field emission display as claimed in claim 18, wherein the step of causing the plurality of electron emitters to emit electrons defines a rate of electron emission, and further comprising the emission-reduction step of causing the rate of electron mission during the step of applying a third anode voltage to be less than the second rate of electron emission.

22. The method for improving life of a field emission display as claimed in claim 21, wherein the field emission display further has a gate electrode, and wherein the emission-reduction step comprises the step of applying to the gate electrode a first gate voltage concurrent with the step of applying a second anode voltage and further comprises the step of applying to the gate electrode a second gate voltage concurrent with the step of applying a third anode voltage, wherein the first gate voltage is greater than the second gate voltage.

23. The method for improving life of a field emission display as claimed in claim 18, wherein the step of applying a first anode voltage to the anode comprises the step of applying a voltage within the range of 1000–3000 volts to the anode, and wherein the step of applying a second anode voltage to the anode comprises the step of applying a voltage within the range of 200–500 volts to the anode.

24. The method for improving life of a field emission display as claimed in claim 23, wherein the step of applying a first anode voltage to the anode comprises the step of applying about 3000 volts to the anode, and wherein the step of applying a second anode voltage to the anode comprises the step of applying about 300 volts to the anode.

* * * * *